US006633117B2

(12) United States Patent
Shinoda et al.

(10) Patent No.: US 6,633,117 B2
(45) Date of Patent: Oct. 14, 2003

(54) DISPLAY DEVICE

(75) Inventors: Tsutae Shinoda, Kawasaki (JP); Akira Tokai, Kawasaki (JP); Hitoshi Yamada, Kawasaki (JP); Manabu Ishimoto, Kawasaki (JP)

(73) Assignee: Fujitsu Limited, Kawasaki (JP)

( * ) Notice: Subject to any disclaimer, the term of this patent is extended or adjusted under 35 U.S.C. 154(b) by 0 days.

(21) Appl. No.: 10/082,118

(22) Filed: Feb. 26, 2002

(65) Prior Publication Data

US 2003/0052592 A1 Mar. 20, 2003

(30) Foreign Application Priority Data

Sep. 17, 2001 (JP) ..... 2001-281195

(51) Int. Cl.[7] ..... H01J 1/62; H01J 63/04; H01J 17/49; H01J 11/00; H01J 61/06

(52) U.S. Cl. ..... 313/484; 313/488; 313/582; 313/607

(58) Field of Search ..... 313/482–485, 313/487–488, 581–582, 584, 493, 234, 572, 641, 607, 573, 576, 642, 1, 634; 362/217–222, 263, 267, 260; 40/545

(56) References Cited

U.S. PATENT DOCUMENTS 5,013,966 A * 5/1991 Saikatsu et al. ..... 313/493
5,444,335 A * 8/1995 Matsumoto et al. ..... 315/246
5,514,934 A * 5/1996 Matsumoto et al. ..... 313/607
6,331,064 B1 * 12/2001 Nishiyama et al. ..... 362/260
2003/0025440 A1 * 2/2003 Ishimoto et al. ..... 313/484
2003/0048068 A1 * 3/2003 Yamada et al. ..... 313/485
2003/0048077 A1 * 3/2003 Ishimoto et al. ..... 313/623

FOREIGN PATENT DOCUMENTS

JP 2000-315460 11/2000

* cited by examiner

*Primary Examiner*—Sandra O'Shea
*Assistant Examiner*—Peter Macchiarolo
(74) *Attorney, Agent, or Firm*—Staas & Halsey LLP

(57) ABSTRACT

A display device is provided in which a structure of a display tube is simplified so as to achieve a cost reduction and electric connection to a driving circuit is made easy. In the display device including a group of display tubes arranged in parallel for emitting light by gas discharge, plural transparent auxiliary electrodes for display are arranged in the length direction on the outer surface of the tubular vessel that defines a discharge gas space of each of the display tubes, so that the position of a discharge portion is determined. The auxiliary electrodes at the same position in the length direction of the vessel are connected to one another electrically via a band-like power supplying conductor provided on a front substrate, and a back substrate is arranged on which a band-like conductor is provided along each of the display tubes at the back side of the group of display tubes.

11 Claims, 13 Drawing Sheets

DISPLAY DEVICE

BACKGROUND OF THE INVENTION

1. Field of the Invention

The present invention relates to a display device made of plural display tubes each of which can emit light partially.

There is a limit to enlarge screen size of a display made of one unit. Therefore, an array type large display in which multiple display tubes are arranged is under development for commercialization.

2. Description of the Prior Art

This type of large display is disclosed in Japanese unexamined patent publication No. 2000-315460. In this publication, FIGS. 15 and 17 show a display device that is made of multiple display tubes arranged in parallel and a substrate for supporting the display tubes. Each display tube includes a glass tube containing discharge gas, strap-like main electrodes (for displaying) arranged on the outer surface of the glass tube along the length direction and a longitudinal sub electrode (for addressing) arranged inside the glass tube so as to cross all the main electrodes. Two main electrodes neighboring with a predetermined gap make an electrode pair for surface discharge. On the substrate, band-like bus electrodes (power supplying conductors) are arranged so as to cross the sub electrode, and the display tube is arranged on the substrate so that the main electrode abuts the bus electrode. The bus electrode makes electric connection among the main electrodes of all the display tubes at the same position in the length direction. Namely, the bus electrode group and the sub electrode group form an electrode matrix. A potential control of the electrode matrix is performed so that any desired image can be displayed.

By forming the main electrodes on each of the display tubes, an area where surface discharge is generated (i.e., a position of a discharge portion) can be determined easily. Furthermore, by forming a bus electrode on the substrate, the electrode matrix can be formed much more simply compared to the case where the main electrodes are connected by printing a conductive paste on the display tubes after arranging the display tubes.

Conventionally, there is a problem that the process for manufacturing the display tube is complicated and that the connection of the sub electrode to the driving circuit is difficult since the sub electrode for forming an electrode matrix with the bus electrode is located inside each of the display tubes.

SUMMARY OF THE INVENTION

An object of the present invention is to simplify the structure of the display tube so as to realize cost reduction and to make connection with a driving circuit easy.

The present invention provides a display device having a structure in which a group of display tubes arranged in parallel are sandwiched between a front substrate and a back substrate, and band-like conductors for forming an electrode matrix are arranged on both the substrates. An auxiliary electrode for display is formed on the display tube so that the position of the discharge portion is determined.

DESCRIPTION OF THE PREFERRED EMBODIMENTS

Hereinafter, the present invention will be explained more in detail with reference to embodiments and drawings.

Figure 1:
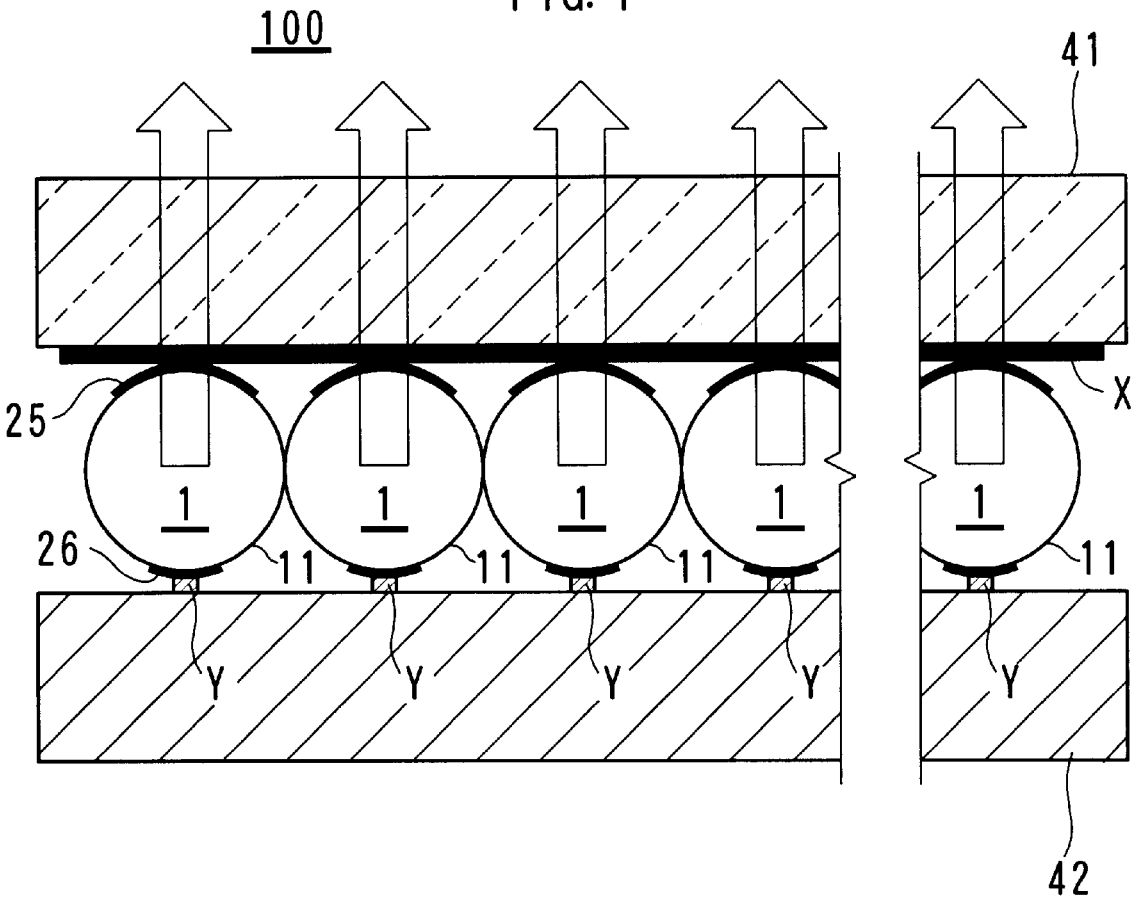
FIG. 1 is a diagram showing a structure of a display device according to the present invention.
Figure 2:
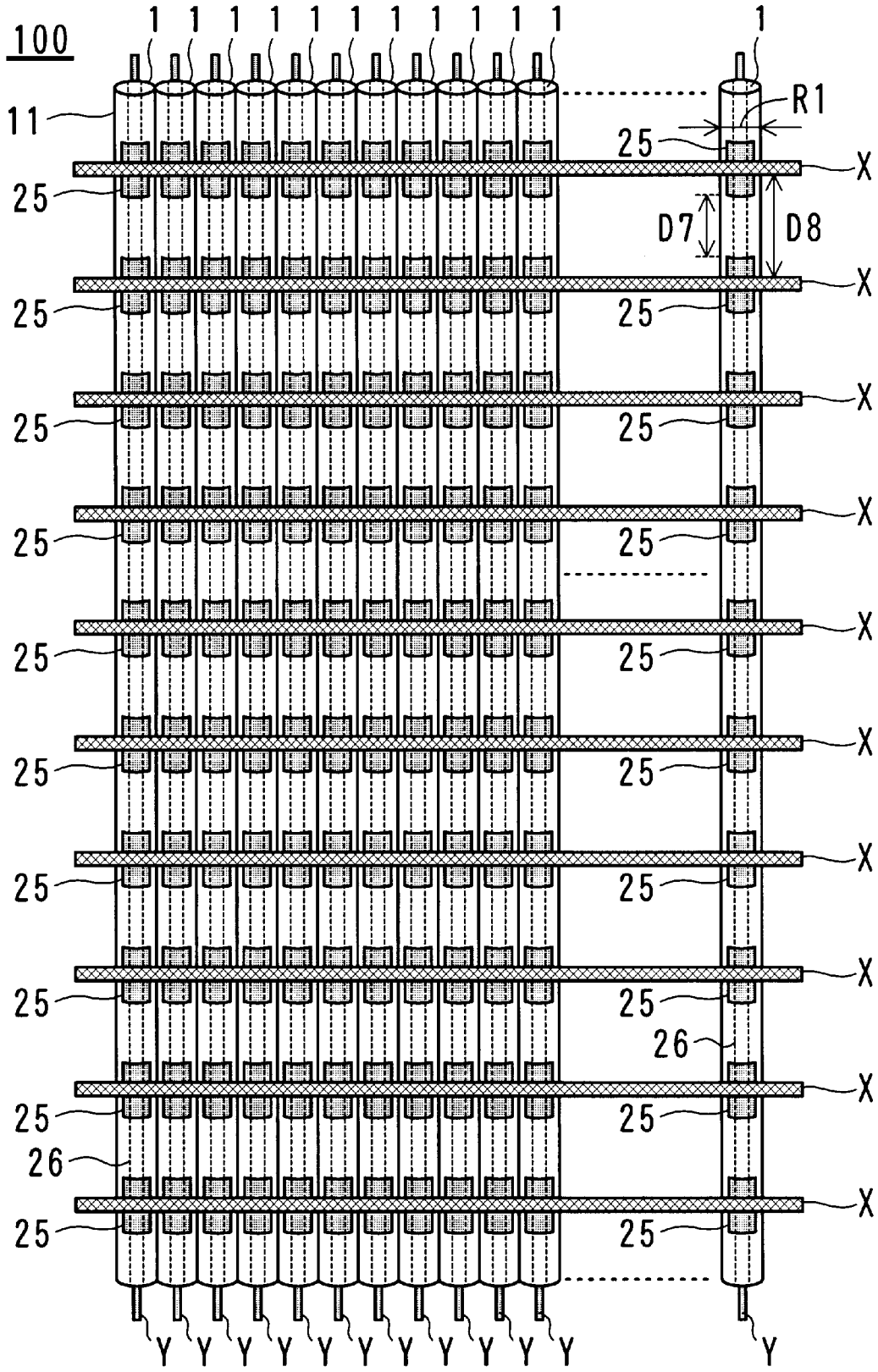
FIG. 2 is a diagram showing a first example of an electrode structure.

FIG. 1 is a diagram showing a structure of a display device according to the present invention. FIG. 2 is a diagram showing a first example of an electrode structure.

The display device 100 comprises a group of display tubes 1 that are arranged in parallel and are lighted by gas discharge, and a pair of substrates 41 and 42, between which the display tubes 1 are sandwiched and supported. The front substrate 41 is transparent, and light rays that are emitted by the display tube 1 and pass through the substrate 41 become display light.

As shown in FIG. 2, the display tube 1 includes a tubular vessel (cylindrical glass tube) 11 defining a discharge gas space, a plurality of first auxiliary electrodes 25 for display that are transparent and are arranged at a constant pitch in the length direction on the front outer surface of the vessel 11 for determining a position of a discharge portion, and a second auxiliary electrode 26 for display that is band-like and is arranged on the back outer surface of the vessel 11. The first auxiliary electrode 25 is a transparent conductive thin film made of ITO or Nesa. The second auxiliary electrode 26 has the length corresponding to the entire length of the vessel 11. Each of the first auxiliary electrodes 25 and the second auxiliary electrode 26 constitute an electrode pair for opposed discharge in the forward and backward direction. The second auxiliary electrode 26 is made of a high reflectivity material so that luminance is enhanced.

Concerning all the display tubes 1, the first auxiliary electrodes 25 at the same position in the length direction of the vessel 11 are connected electrically to one another via a band-like power supplying electrode X for display. The power supplying electrodes X are provided on the front substrate 41. The second auxiliary electrode 26 is connected to a driving circuit via a power supplying electrode Y disposed on the back substrate 42. The power supplying electrode Y is overlapped with the second auxiliary electrode 26 over the entire length thereof. The power supplying electrodes X and the power supplying electrodes Y form an electrode matrix. It is possible to omit the second auxiliary electrode 26 for display, so that the first auxiliary electrode 25 for display and the power supplying electrode Y for display form an electrode pair.

The size of the power supplying electrode X in the length direction of the vessel 11 is smaller than the first auxiliary electrode 25, and each of the first auxiliary electrodes 25 protrudes at both sides of the corresponding power supplying electrode X. Namely, the gap size D8 between the power supplying electrodes X is larger than the gap size D7 between the first auxiliary electrodes 25. In the display device 100, the gap size D8 is set to a value larger than the outer diameter R1 of the vessel 11.

Figure 3:
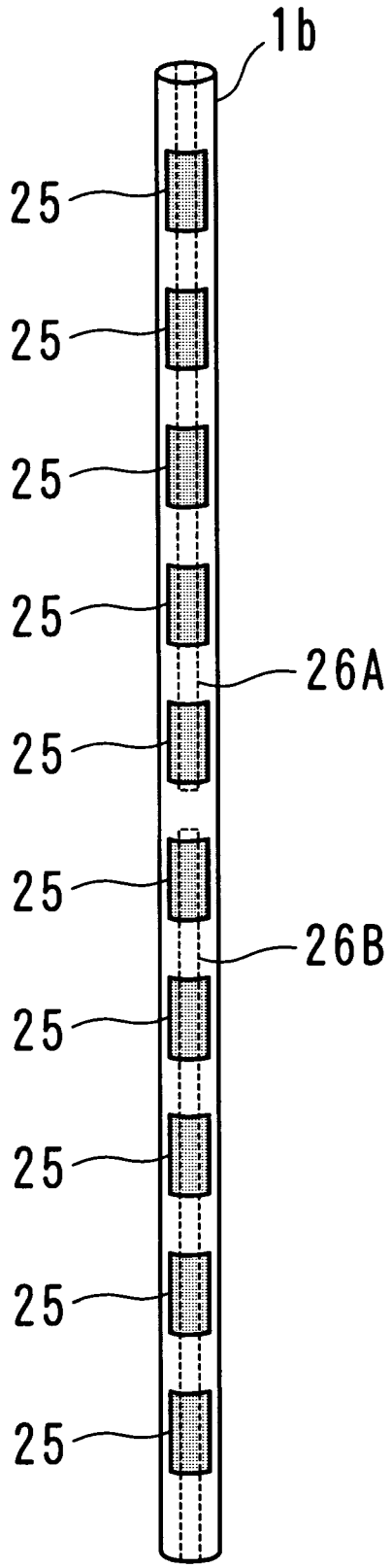
FIG. 3 shows a variation of the electrode.

FIG. 3 shows a variation of the electrode.

In a display tube 1*b,* a second auxiliary electrode is cut off at the center in the length direction. According to this structure, double scanning is performed in which one part 26A of the second auxiliary electrode and the other part 26B of the second auxiliary electrode are controlled independently of each other, so that the time necessary for selecting a discharge portion for display can be reduced in half.

Figure 4:
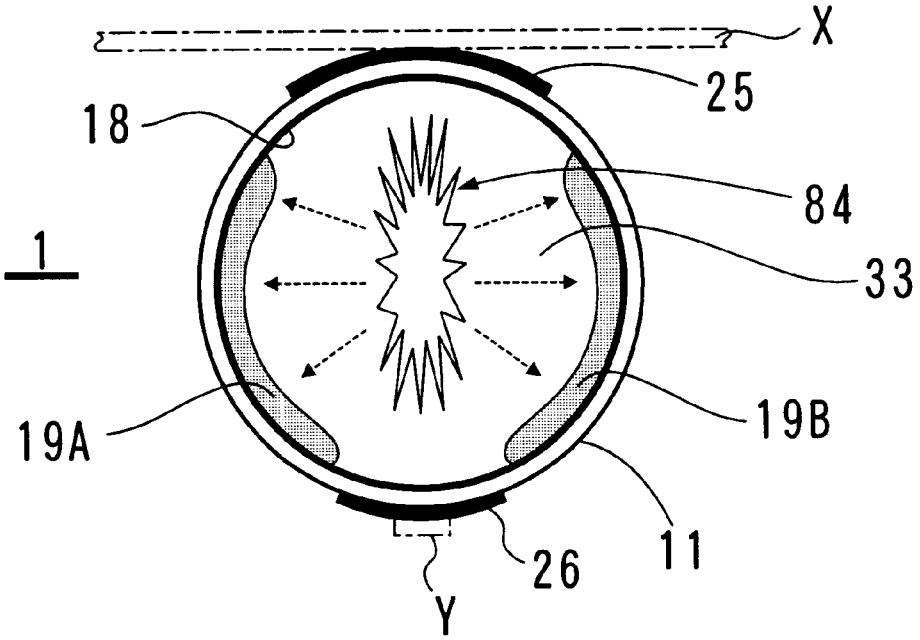
FIG. 4 is a cross section showing an example of the inner structure of the display tube.
Figure 5:
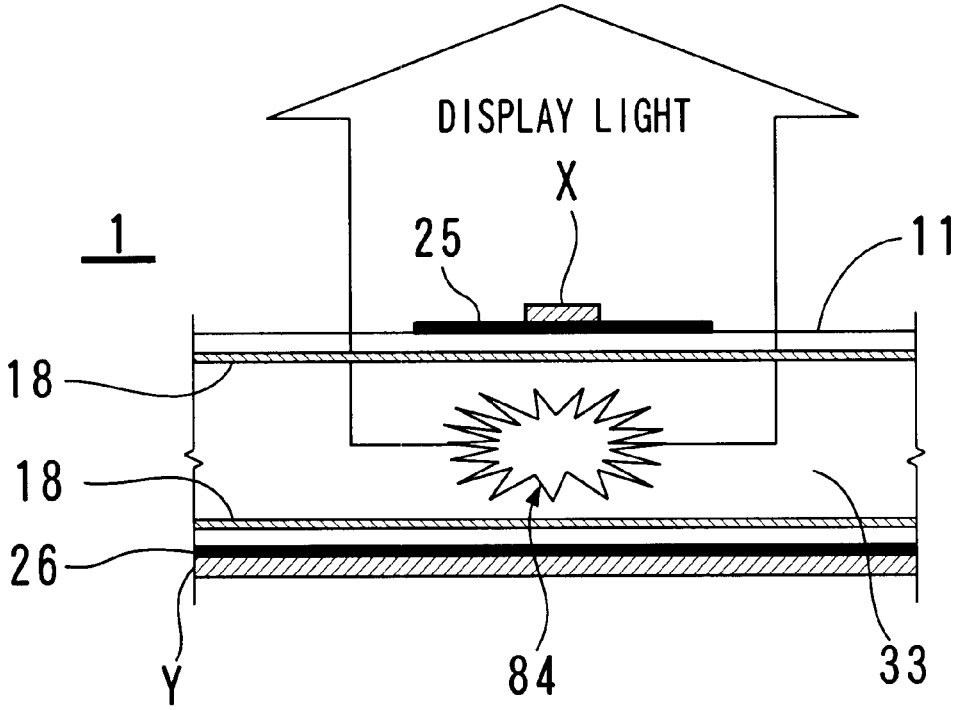
FIG. 5 shows a concept of opposed discharge.

FIG. 4 is a cross section showing an example of the inner structure of the display tube. FIG. 5 shows a concept of opposed discharge.

The inner surface of the vessel 11 is coated with a second electron emission layer 18 made of magnesia. In addition, fluorescent material layers 19A and 19B are located separately on the right and the left portion of the inner side of the vessel 11 so as to avoid the area where the first auxiliary electrode 25 and the second auxiliary electrode 26 are formed. The second electron emission layer 18 is formed by a method of baking after coating liquid organometallic solution or CVD method. Concerning the fluorescent material layer, there is also a form in which it is formed on the entire inner surface. If the fluorescent material is located also in the vicinity of the auxiliary electrode, it is desirable to use a fluorescent material coated with a material that has resistance to spattering and is transparent for wavelength of a vacuum ultraviolet.

When a predetermined voltage is applied to the power supplying electrodes X and Y, opposed discharge 84 is generated in the discharge gas space 33 along the forward and backward direction of the vessel 11. The fluorescent material layers 19A and 19B are excited by ultraviolet rays emitted by the discharge gas so as to emit light.

Figure 6:
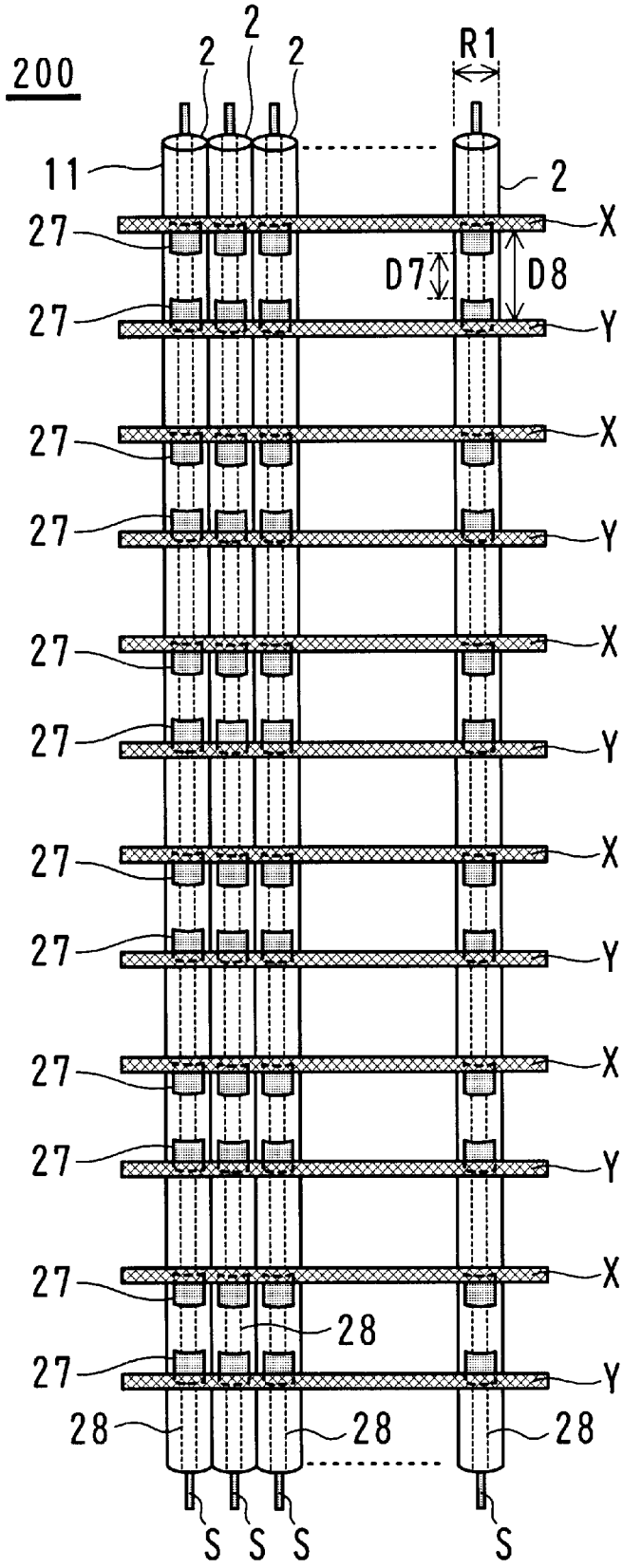
FIG. 6 shows a second example of the electrode structure.

FIG. 6 shows a second example of the electrode structure.

A display tube 2 of a display device 200 includes auxiliary electrodes 27 for display arranged on the front outer surface of the vessel 11 so that a pair of auxiliary electrodes 27 generates surface discharge along the length direction, and one band-like auxiliary electrode 28 for selection (data) on the back outer surface of the vessel 11. The auxiliary electrode 27 is a transparent conductive thin film made of ITO or Nesa. Two neighboring auxiliary electrodes 27 constitute an electrode pair for the surface discharge. The auxiliary electrode 28 for selection has the length corresponding to the entire length of the vessel 11. The auxiliary electrode 28 for selection is made of a high reflectance material so that the luminance is enhanced.

The auxiliary electrodes 27 of all the display tubes 2 at the same position in the length direction of the vessel 11 are connected electrically to one another via the band-like power supplying electrode X or the power supplying electrode Y. The power supplying electrodes X and Y are arranged on the front substrate. The auxiliary electrode 28 for selection is connected with the driving circuit via a power supplying electrode S for selection arranged on the back substrate. The power supplying electrode S for selection overlaps the auxiliary electrode 27 for selection over the entire length. The power supplying electrodes X and Y and the power supplying electrode S constitute an electrode matrix. Here, the auxiliary electrode 28 for selection can be omitted as a variation. This omission reduces the number of manufacture process of the display tube 2, so that more inexpensive display tube 2 can be provided. In the structure where the auxiliary electrode 28 for selection is omitted, the width of the power supplying electrode S can be widened so that the discharge for selection can be generated securely.

Each of the auxiliary electrodes 27 protrudes from one side of the corresponding power supplying electrode X or the power supplying electrode Y. The gap size D8 between the power supplying electrodes X and Y corresponding to the auxiliary electrode pair for the surface discharge in each of the display tubes 2 is larger than the surface discharge gap size D7. In the display device 200, the gap size D8 is set to a value larger than the outer diameter R1 of the vessel 11 for enlarging the area of the surface discharge so as to enhance the efficiency of the light emission.

Figure 7A:
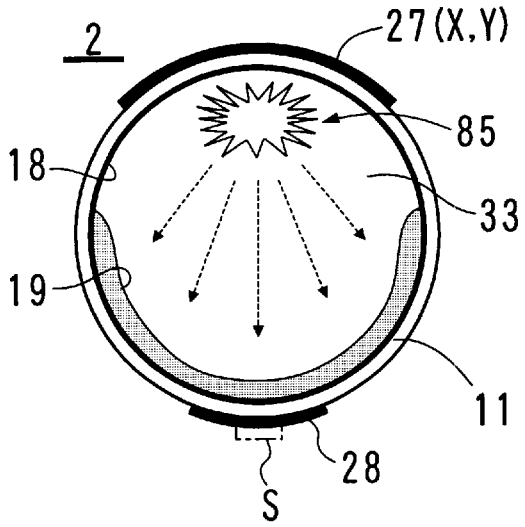
FIGS. 7A and 7B are cross sections showing the inner structure of the display tube.
Figure 7B:
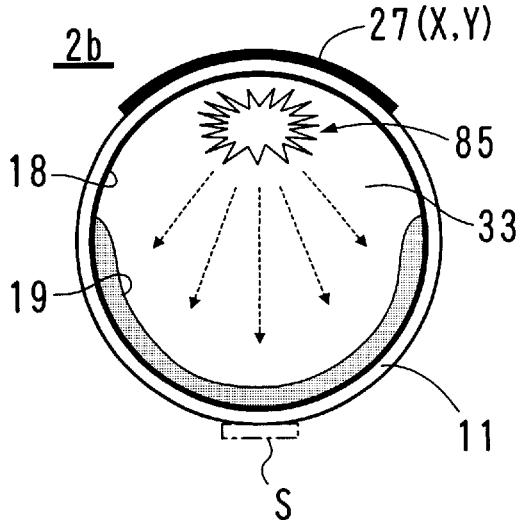

FIGS. 7A and 7B are cross sections showing the inner structure of the display tube. The display tube 2 having the auxiliary electrode 28 for selection shown in FIG. 7A and a display tube 2*b* omitting the auxiliary electrode 28 for selection shown in FIG. 7B have the same inner structure.

The inner surface of the vessel 11 is coated with the second electron emission layer 18. The fluorescent material layer 19 is arranged on the inner side of the vessel 11 so as to avoid the area where the auxiliary electrode 27 is formed. The second electron emission layer 18 can be formed by coating liquid organometallic solution and burning it, or the CVD method. There can be a structure in which the fluorescent material layer is formed on the entire inside surface. If the fluorescent material is arranged adjacent to the auxiliary electrode too, it is desirable to use a fluorescent material coated with a material having resistance to spattering and being transparent for wavelength of a vacuum ultraviolet.

Figure 8:
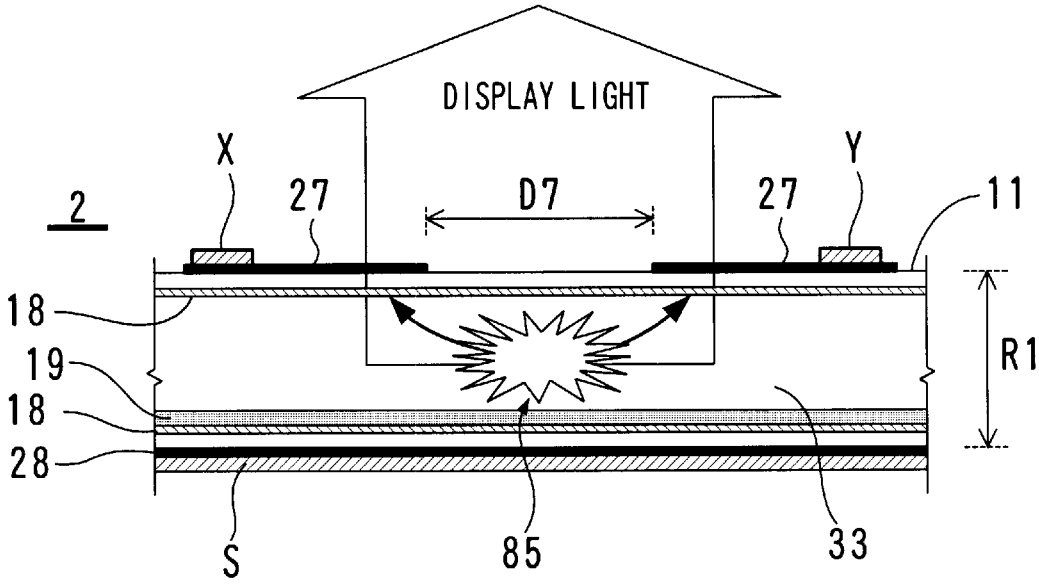
FIG. 8 shows a concept of surface discharge.

FIG. 8 shows a concept of surface discharge.

When a predetermined voltage is applied to the power supplying electrodes X and Y, surface discharge 85 is generated by the auxiliary electrode pair for display along the length direction of the vessel 11 at the front portion (upper portion in FIG. 8) of the discharge gas space 33. By enlarging the surface discharge gap size D7, the efficiency of emitting the ultraviolet light is increased, so that the fluorescent material layer 19 can emit light efficiently.

Figure 9:
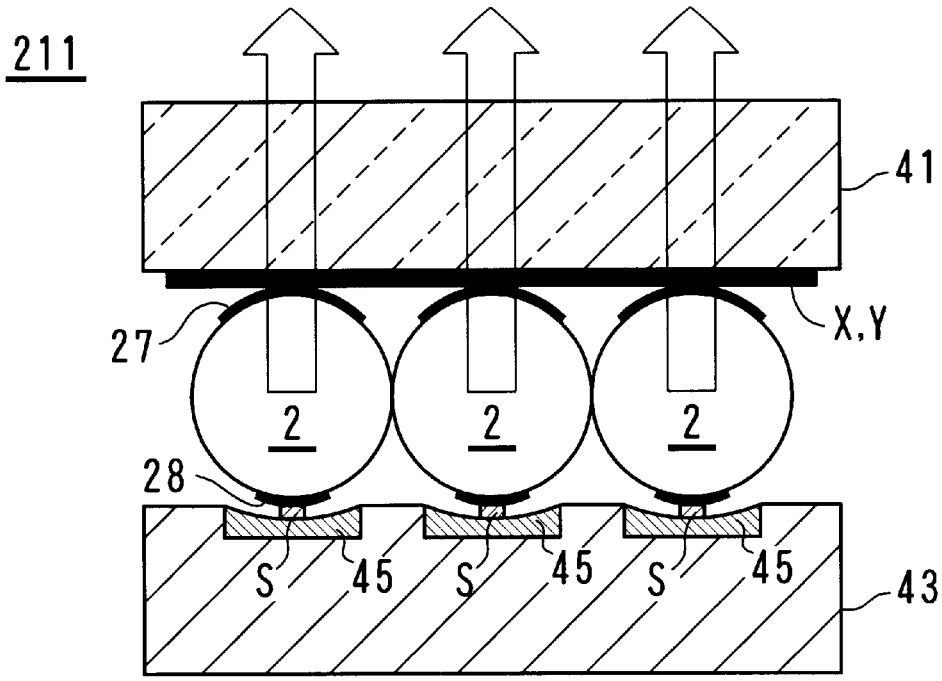
FIG. 9 is a schematic diagram of a first variation of a structure for supporting the display tube.

FIG. 9 is a schematic diagram of a first variation of a structure for supporting the display tube.

A display device 211 has an elastic insulator layer 45 on a back substrate 43. The accuracy of a tube diameter is approximately ±2% of the diameter, and there can be the difference of 4% between the neighboring display tubes. If the display tube 2 is sandwiched between flat substrates, the electric connection between the substrate and the display tube 2 can be incomplete. By providing the elastic insulator layer 45, the electric connection can be perfect. Namely, a tolerance of variation in the tube diameter can be enlarged.

Figure 10:
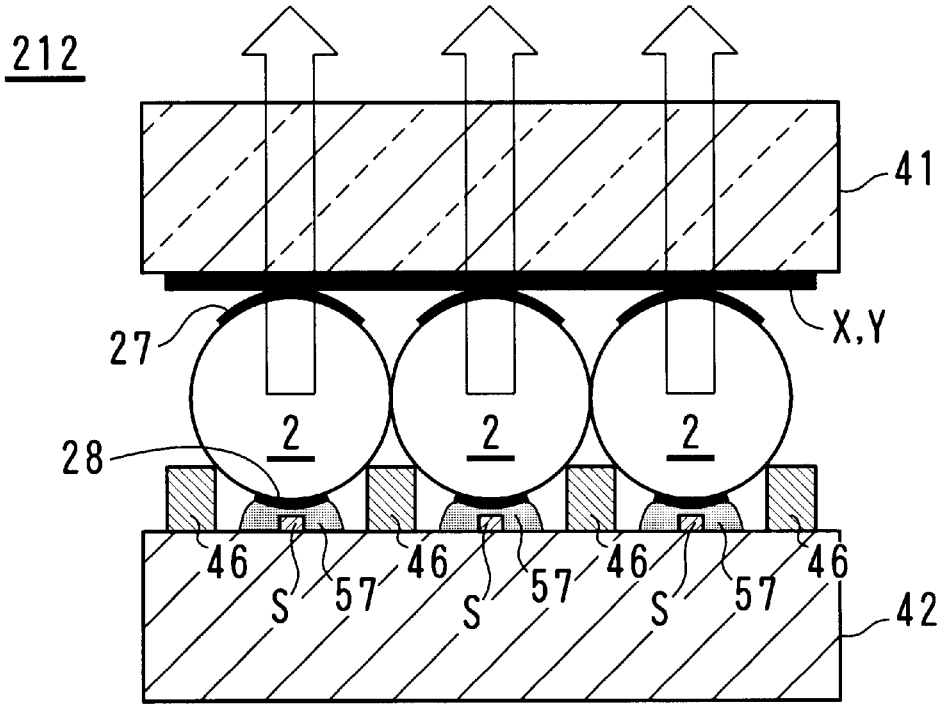
FIG. 10 is a schematic diagram of a second variation of the structure for supporting the display tube.

FIG. 10 is a schematic diagram of a second variation of the structure for supporting the display tube.

A display device 212 has a conductive bonding material 57 between the back substrate 42 and the display tube 2, so that reliability of electric connection can be secured. In addition, the substrate 42 has protrusions 46 for registration of the display tube 2. The height of the protrusion 46 is set to an appropriate value smaller than the radius of the display tube 2, so that the display tubes 2 can be arranged closely, and high definition of the display can be realized.

Figure 11:
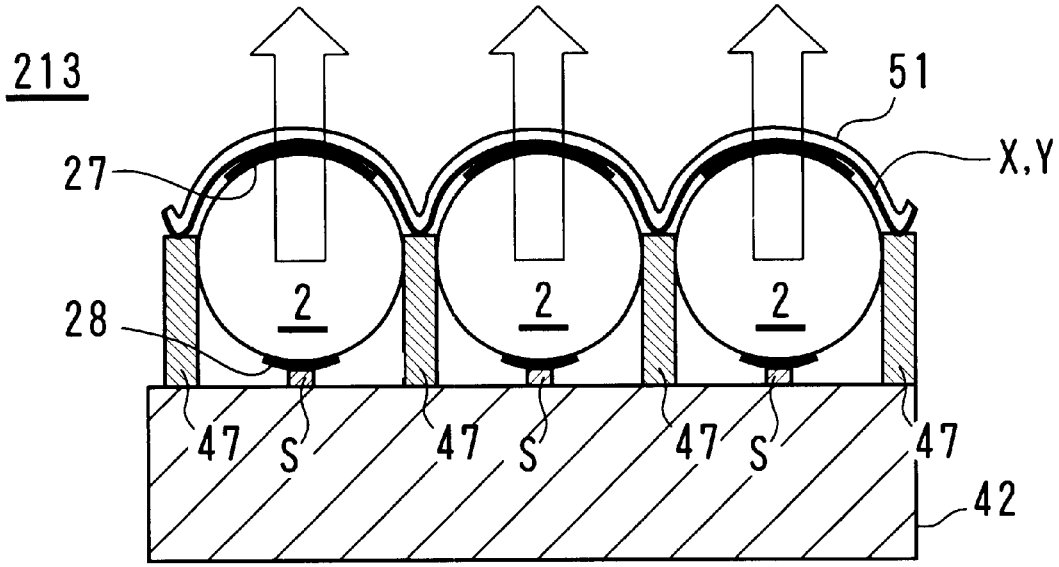
FIG. 11 is a schematic diagram according to a third variation of the structure for supporting the display tube.

FIG. 11 is a schematic diagram according to a third variation of the structure for supporting the display tube.

A display device 213 includes protrusions 47 that have a height larger than the radius of the display tube 2 and are arranged at a constant pitch on the back substrate 42. The positions of the display tubes 2 are adjusted by the protrusions 47. In addition, the front portion of the display tube 2 is covered with a flexible transparent sheet 51, and the first auxiliary electrode 25 is supplied with power via the power supplying electrodes X and Y formed on the transparent sheet 51. Since the transparent sheet 51 has some flexibility, the electric connection can be made despite of the variation of the tube diameter.

Figure 12:
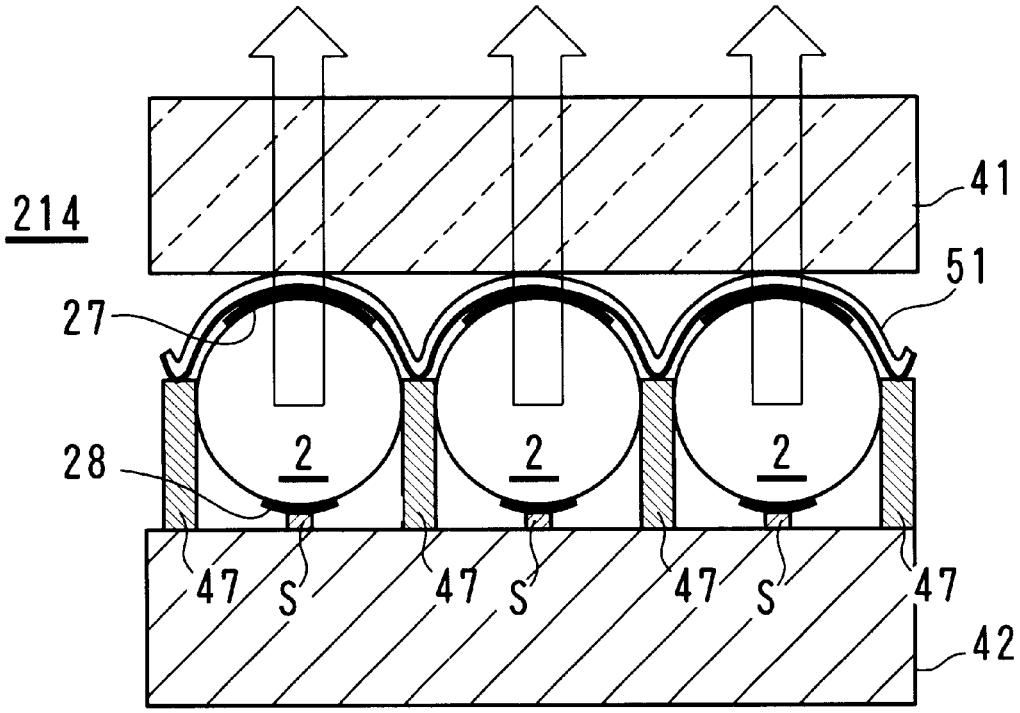
FIG. 12 is a schematic diagram of a fourth variation of the structure for supporting the display tube.

FIG. 12 is a schematic diagram of a fourth variation of the structure for supporting the display tube.

A display device 214 has a structure in which mechanical strength is increased by disposing a substrate 41 in front of the transparent sheet 51 of the display device 213 shown in FIG. 9.

Figure 13:
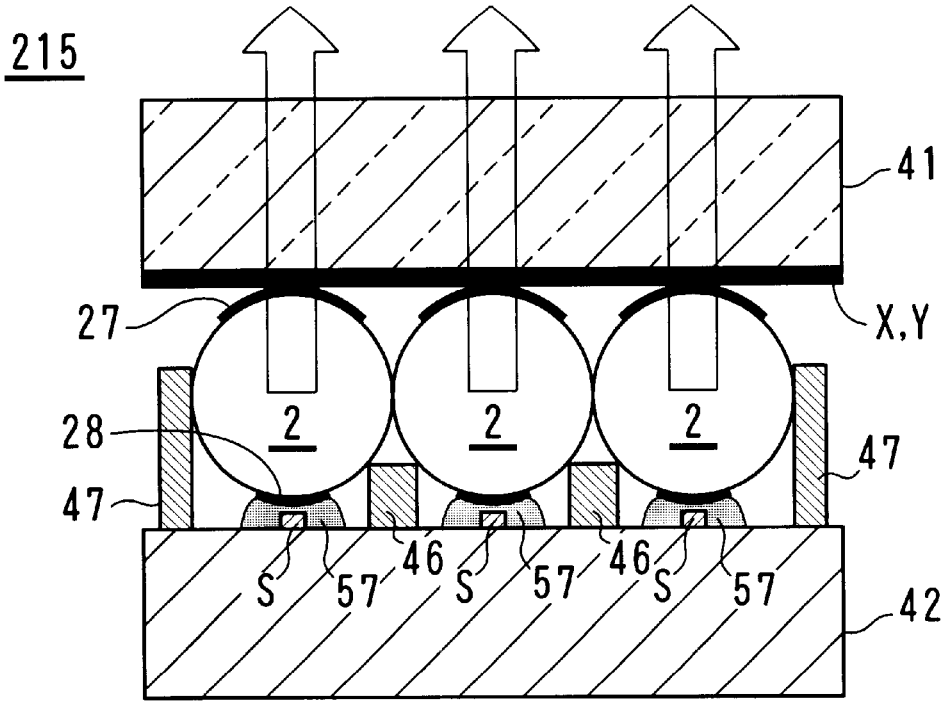
FIG. 13 is a schematic diagram of a fifth variation of the structure for supporting the display tube.

FIG. 13 is a schematic diagram of a fifth variation of the structure for supporting the display tube.

In a display device 215, three display tubes 2 having different light emission colors (e.g., red, green and blue colors) are arranged closely as a set, and the protrusion 47 having a height larger than the radius of the display tube 2 is disposed between the sets. This structure is preferable to the case where a pixel including three discharge portions is defined clearly for color display.

Figure 14:
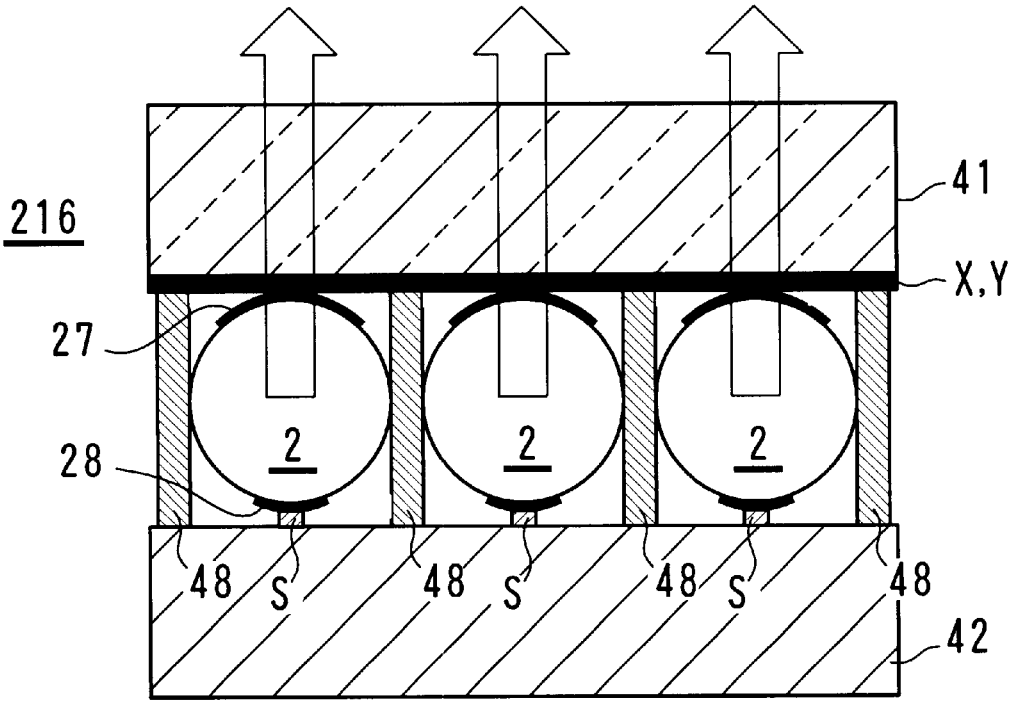
FIG. 14 is a schematic diagram of a sixth variation of a structure for supporting the display tube.

FIG. 14 is a schematic diagram of a sixth variation of a structure for supporting the display tube.

A display device 216 includes protrusions 48 that have heights approximately the same as the diameter of the display tube 2 and are arranged so as to sandwich each of the display tubes 2. This structure is preferable for defining a cell in the direction of the tube arrangement.

Figure 15A:
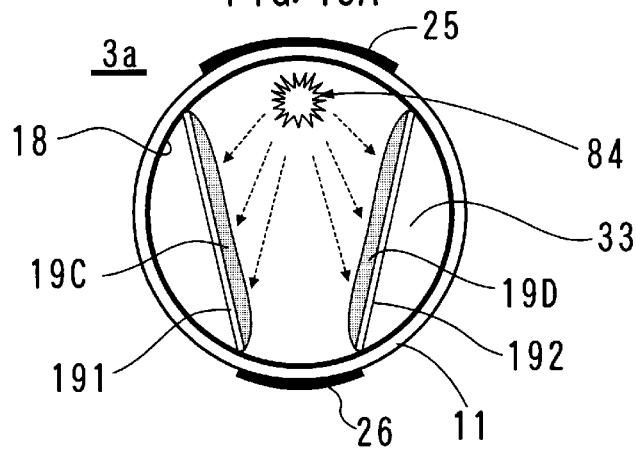
FIGS. 15A, 15B and 15C are cross sections showing variations of fluorescent material arrangement.
Figure 15B:
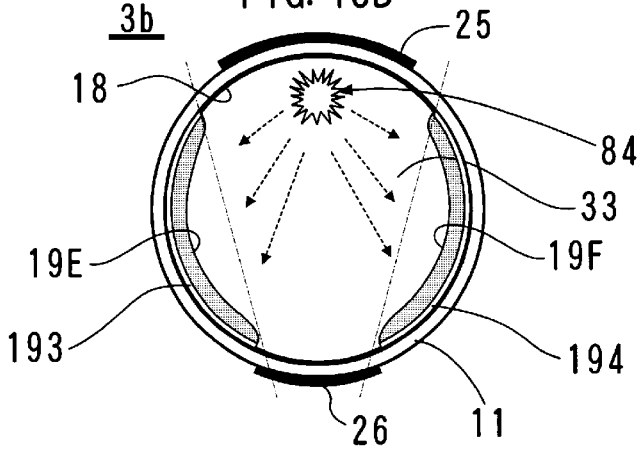
Figure 15C:
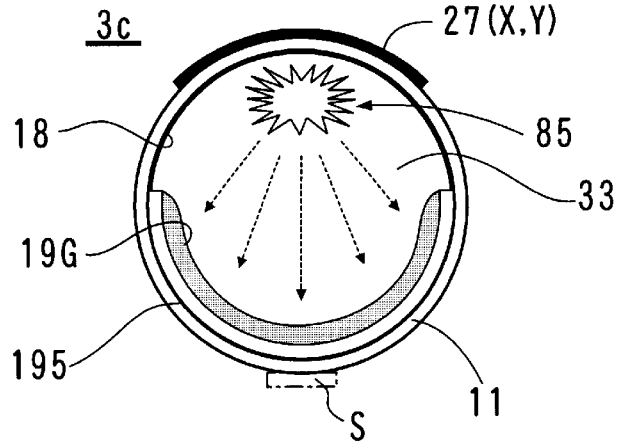

FIGS. 15A, 15B and 15C are cross sections showing variations of the fluorescent material arrangement.

In a display tube 3*a,* instead of arranging the fluorescent material directly on the inner surface of the vessel 11, fluorescent material layers 19C and 19D are formed on plates (supporting members) 191 and 192 separate from the vessel 11. The plates 191 and 192 are inserted inside the vessel 11 so that the fluorescent material layers 19C and 19D are placed in the discharge gas space 33. The plates 191 and 192 are arranged in a slanting direction to the forward and backward direction so that the front sides are opposed with a distance larger than the back side. Thus, the luminance is improved. In display tubes 3*b* and 3*c,* fluorescent material layers 19E, 19F and 19G are formed on curved plates 193, 194 and 195 having an arc-like cross section. The plates 193, 194 and 195 are inserted inside the vessel 11 so that the fluorescent material layers 19E, 19F and 19G are placed in the discharge gas space 33. In this way, the fluorescent material is formed on the supporting member that is separate from the vessel 11, so that the display tubes 3*a,* 3*b* and 3*c* are manufactured in a short time compared with the case where the fluorescent material is directly arranged on the inner surface of the vessel 11.

Figure 16A:
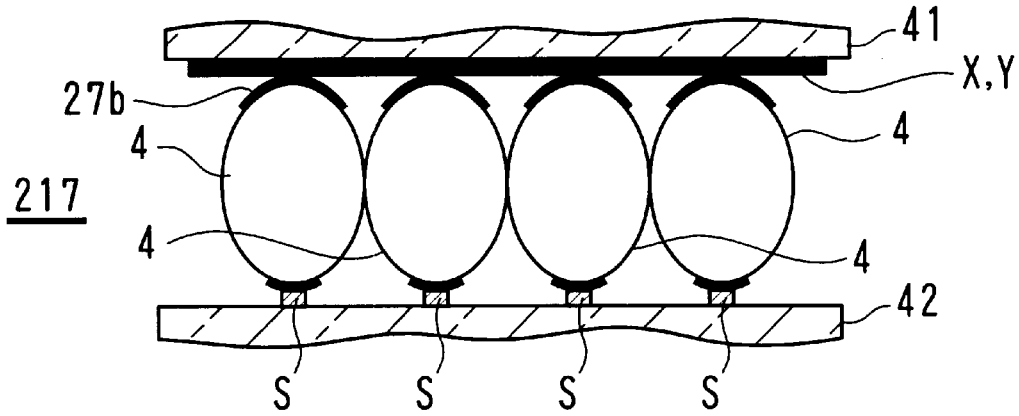
FIGS. 16A, 16B and 16C show variations of a cross section of the display tube.
Figure 16B:
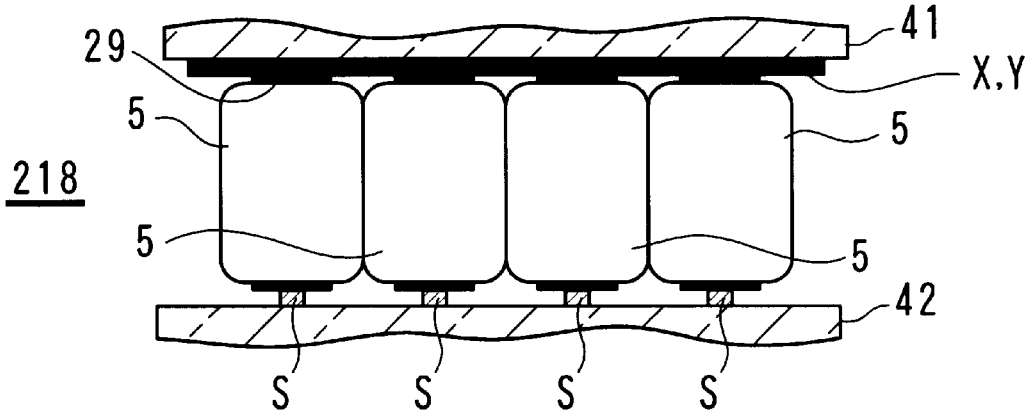
Figure 16C:
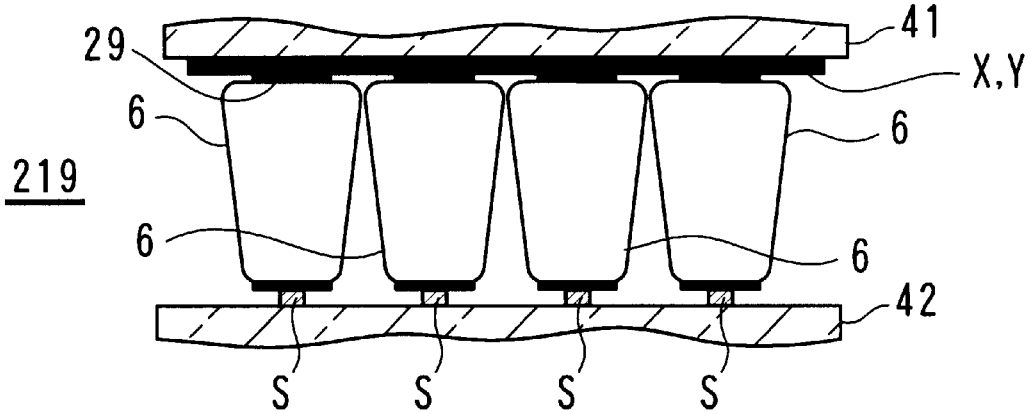

FIGS. 16A, 16B and 16C show variations of a cross section of the display tube.

The cross section of a display tube 4 in a display device 217 has a contour of an ellipse. The display tube 4 includes an auxiliary electrode 27*b.* Since the contour of the cross section is an ellipse having the major axis in the forward and backward direction, the arrangement pitch of the display tubes 4 can be decreased compared with the case where the contour of the cross section is a circle.

The cross section of a display tube 5 in a display device 218 is rectangular. The display tube 5 includes display electrodes 29. Since the contour of the cross section is a rectangle having the longer axis in the forward and backward direction, sufficient volume of the discharge gas space is secured while the arrangement pitch of the display tube 5 can be decreased.

The cross section of a display tube 6 in a display device 219 has a contour of a trapezoid. Since the contour of the cross section is a trapezoid whose width increases toward the front side, a viewing angle and luminance is increased, and the arrangement pitch of the display tube 6 can be reduced.

Figure 17:
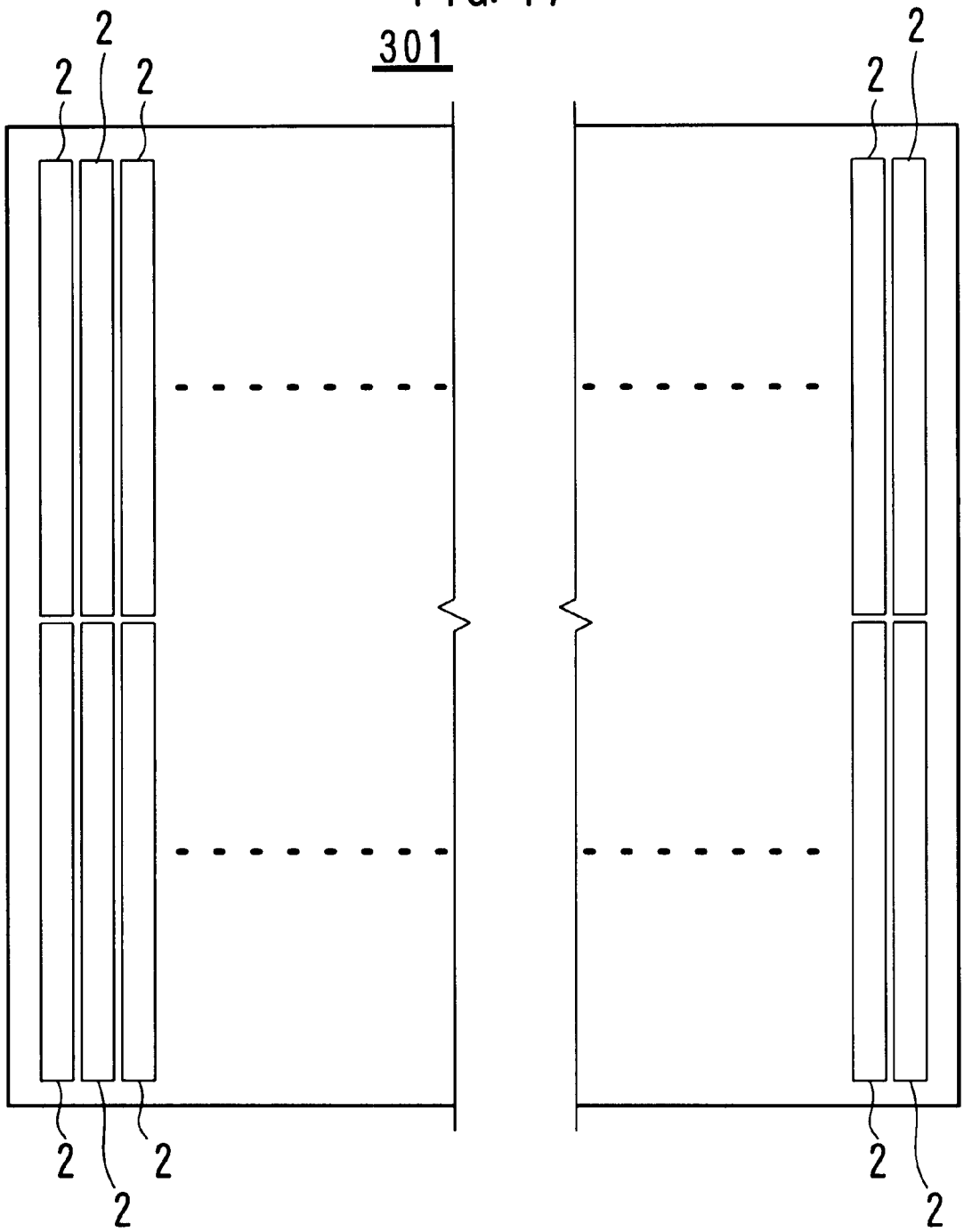
FIG. 17 shows a first variation in the display tube arrangement.

FIG. 17 shows a first variation in the display tube arrangement.

In a display device 301, two display tubes 2 arranged in series make one column of the matrix display. It is possible to arrange three or more display tubes 2 in series so as to enlarge the display screen.

Figure 18:
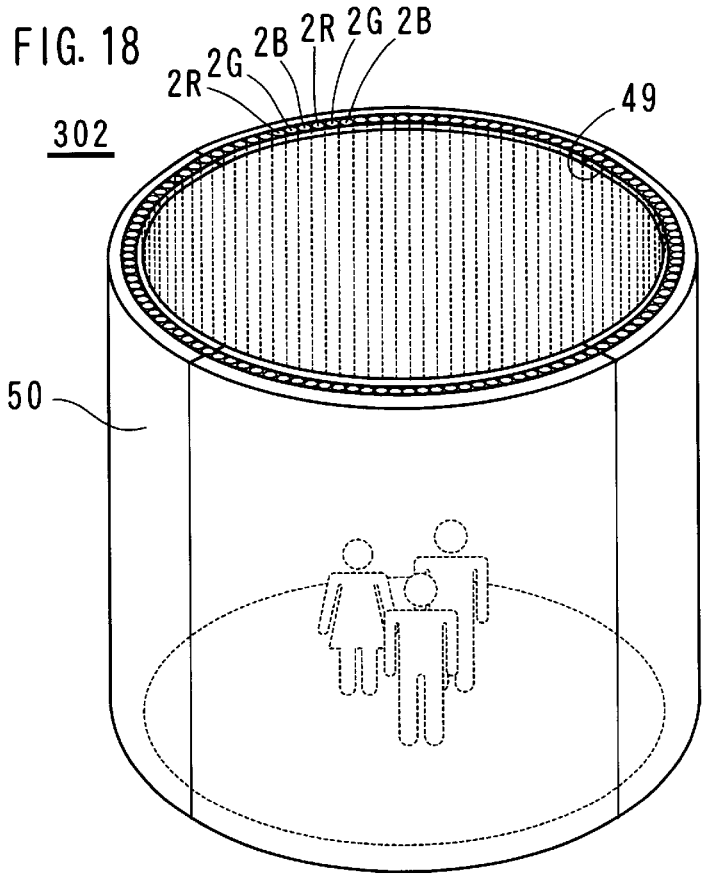
FIG. 18 shows a second variation of the display tube arrangement.

FIG. 18 shows a second variation of the display tube arrangement.

In a display device 302, three types of display tubes 2R, 2G and 2B having different display colors are arranged on an inner surface, i.e., a curved surface of a cylindrical support wall 50. The display colors of the display tubes 2R, 2G and 2B are red, green and blue, respectively. A cylindrical transparent protection wall 49 is provided in front of the display tubes 2R, 2G and 2B. Since the display tubes 2R, 2G and 2B are arranged so as to surround viewers, display providing realism and enthusiasm can be realized. Instead of the structure surrounding 360° area, it can be the structure surrounding 180° area, for example. It is possible to arrange the display tubes on the surface that has a flat middle portion and curves at both ends.

Figure 19:
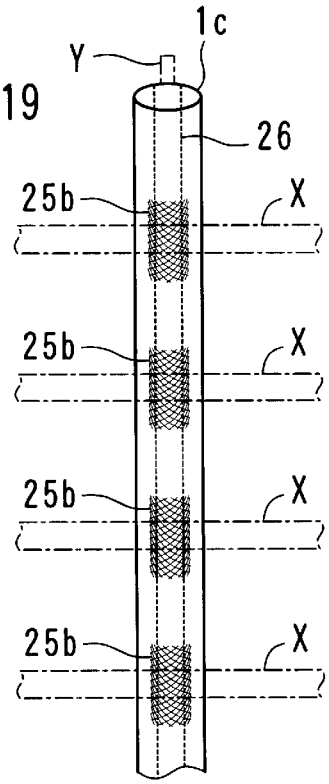
FIG. 19 shows another example of an auxiliary electrode for display.

FIG. 19 shows another example of the auxiliary electrode for display.

In a display tube 1*c,* first auxiliary electrodes 25*b* for display are made of a metal mesh. Though the metal is a shade, light rays pass through the mesh. Therefore, the metal mesh is one type of transparent conductor.

While the presently preferred embodiments of the present invention have been shown and described, it will be understood that the present invention is not limited thereto, and that various changes and modifications may be made by those skilled in the art without departing from the scope of the invention as set forth in the appended claims.

What is claimed is:

1. A display device comprising:

a group of display tubes arranged in parallel emitting light by gas discharge, each of the display tubes including a tubular vessel defining a discharge gas space and a plurality of transparent auxiliary electrodes for display arranged on the front outer surface of the vessel in the length direction, setting a position of a discharge portion;

a band-like power supplying conductor for display arranged on a front substrate, via which the auxiliary electrodes for display at the same position in the length direction of the vessel are connected electrically to one another among the display tubes; and a band-like conductor arranged on a back substrate along the display tubes at the back side of the display tubes.

2. A display device as recited in claim 1, wherein a plurality of display tubes is allocated to one column, and the display tubes are arranged in series in the length direction in each column.

3. A display device as recited in claim 1, wherein the conductor is supported by the back substrate via an elastic insulator.

4. A display device as recited in claim 1, wherein a band-like auxiliary conductor film having a length over two or more auxiliary electrodes for display is formed on the rear outer surface of each of the display tubes.

5. A display device as recited in claim 4, wherein the auxiliary conductor film of each of the display tubes is connected to the conductor of the back substrate via an anisotropy conductor.

6. A display device as recited in claim 1, wherein a plurality of band-like conductor is arranged for each of the display tubes on the back substrate, and discharge controls for plural discharge portions are performed simultaneously.

7. A display device as recited in claim 1, wherein a fluorescent material layer emitting light by gas discharge is formed on a supporting member that is separated from the tube, and the supporting member is inserted inside the tube so that the fluorescent material layer is placed in the discharge gas space.

8. A display device as recited in claim 1, wherein the front substrate is a flexible substrate, which is curved along the outer surface of the display tube.

9. A display device as recited in claim 1, wherein a protrusion is provided on the back substrate for registration of the display tube.

10. A display device as recited in claim 1, wherein the group of display tubes is arranged on a cylindrical curved surface.

11. A display device comprising:

a group of display tubes arranged in parallel emitting light by gas discharge, each of the display tubes including a tubular vessel defining a discharge gas space and a plurality of transparent auxiliary electrodes for display arranged on the front outer surface of the vessel in the length direction so that surface discharge is generated along the length direction; and a band-like power supplying conductor for display, via which the auxiliary electrodes for display at the same position in the length direction of the vessel are connected electrically to one another among the display tubes; wherein the size of the power supplying conductor for display in the length direction of the vessel is smaller than the auxiliary electrode for display, and a gap between the power supplying electrodes for display corresponding to a pair of auxiliary electrodes for surface discharge in display in each of the display tubes is larger than the outer diameter of the vessel.

* * * * *